US011122855B2

(12) United States Patent
Van Horne et al.

(10) Patent No.: US 11,122,855 B2
(45) Date of Patent: Sep. 21, 2021

(54) HOCKEY SKATE

(71) Applicant: BAUER HOCKEY, LLC, Exeter, NH (US)

(72) Inventors: Scott Van Horne, Calgary (CA); David Wright Cruikshank, Delafield, WI (US)

(73) Assignee: BAUER HOCKEY, LLC, Exeter, NH (US)

( * ) Notice: Subject to any disclaimer, the term of this patent is extended or adjusted under 35 U.S.C. 154(b) by 419 days.

(21) Appl. No.: 15/963,198

(22) Filed: Apr. 26, 2018

(65) Prior Publication Data

US 2018/0242682 A1 Aug. 30, 2018

Related U.S. Application Data

(63) Continuation of application No. 15/654,022, filed on Jul. 19, 2017, now abandoned, which is a continuation of application No. 14/810,321, filed on Jul. 27, 2015, now Pat. No. 9,717,300, which is a continuation of application No. 14/028,258, filed on Sep. 16, 2013, now abandoned, which is a continuation of application No. 13/271,029, filed on Oct. 11, 2011, now Pat. No. 8,596,650, which is a continuation of application No. 12/609,627, filed on Oct. 30, 2009, now abandoned.

(51) Int. Cl.

| | |
|---|---|
| ***A63C 1/22*** | (2006.01) |
| ***A43B 5/16*** | (2006.01) |
| ***A43B 23/26*** | (2006.01) |

(52) U.S. Cl.

CPC ..... *A43B 5/16* (2013.01); *A43B 5/1691* (2013.01); *A43B 23/26* (2013.01); *A63C 1/22* (2013.01)

(58) Field of Classification Search

CPC ... A43B 5/1625; A43B 5/1666; A43B 5/1691; A43B 7/20; A43B 23/26; A43B 5/16; A63C 1/22

See application file for complete search history.

(56) References Cited

U.S. PATENT DOCUMENTS

| | | | |
|---|---|---|---|
| 2,789,374 | A | 5/1955 | Planert |
| 3,235,978 | A | 2/1966 | Hyde |
| 3,325,919 | A | 6/1967 | Robinson |
| 3,729,841 | A | 5/1973 | Wagner |
| 3,895,405 | A | 7/1975 | Edwards |

(Continued)

OTHER PUBLICATIONS

Non Final Office Action dated Sep. 2, 2015 in connection with U.S. Appl. No. 14/810,321, 14 pages.

(Continued)

*Primary Examiner* — Frank B Vanaman

(57) ABSTRACT

A skate assembly includes a shell structure and a removable tendon guard. The shell structure includes a heel portion, a lateral ankle portion, and a medial ankle portion. The heel portion is formed to cover a human heel. The lateral ankle portion is formed to extend beyond the heel portion. The medial ankle portion is formed to extend beyond the heel portion. The lateral ankle portion and the medial ankle portion are spaced apart to form a notch extending toward the heel portion. The removable tendon guard is removably attached between the lateral ankle portion and medial ankle portion to cover the notch.

36 Claims, 12 Drawing Sheets

(56) References Cited

U.S. PATENT DOCUMENTS

| | | | | |
|---|---|---|---|---|
| 4,045,886 | A | 9/1977 | Terasaki | |
| 4,384,413 | A | 5/1983 | Bourque | |
| 4,433,494 | A | 2/1984 | Courvoisier | |
| 4,463,761 | A | 8/1984 | Pols | |
| 4,509,276 | A | 4/1985 | Bourque | |
| 4,655,465 | A | 4/1987 | Schaeffer | |
| 4,716,662 | A | 1/1988 | Bar | |
| 4,778,717 | A | 10/1988 | Fitchmun | |
| 4,794,706 | A | 1/1989 | Puckhaber | |
| 4,869,001 | A | 9/1989 | Brown | |
| 4,901,390 | A | 2/1990 | Daley | |
| 4,964,229 | A | 10/1990 | Laberge | |
| 5,003,708 | A | 4/1991 | Daley | |
| 5,282,326 | A | 2/1994 | Schroer | |
| 5,408,763 | A | 4/1995 | Sartor | |
| 5,437,466 | A | 8/1995 | Melbock | |
| 5,491,911 | A | 2/1996 | Chen | |
| 5,673,448 | A | 10/1997 | Lang | |
| 5,733,647 | A | 3/1998 | Moore | |
| 5,779,246 | A | 7/1998 | Bengtsson | |
| 5,840,053 | A | 11/1998 | Roth | |
| 5,885,622 | A | 3/1999 | Daley | |
| 5,887,361 | A | 3/1999 | Cabanis | |
| 5,893,222 | A | 4/1999 | Donnelly | |
| 5,926,979 | A | 7/1999 | Borel | |
| 5,933,986 | A | 8/1999 | Donnadieu | |
| 5,989,715 | A * | 11/1999 | Kiriazis | B32B 27/40 428/425.1 |
| 6,079,128 | A | 6/2000 | Hoshizaki | |
| 6,346,210 | B1 | 2/2002 | Swartz | |
| 6,550,159 | B1 | 4/2003 | Madore | |
| 6,703,142 | B2 | 3/2004 | Snow | |
| 6,769,203 | B1 | 8/2004 | Wright | |
| 6,935,054 | B2 | 8/2005 | Hall | |
| 7,008,386 | B2 | 3/2006 | Alaimo | |
| 7,325,813 | B2 | 2/2008 | Bock | |
| 7,398,609 | B2 | 7/2008 | Labonté | |
| 7,418,755 | B2 | 9/2008 | Bledsoe | |
| 7,451,991 | B2 | 11/2008 | Labonté | |
| 7,533,479 | B2 | 5/2009 | Labonté | |
| 7,640,680 | B1 | 1/2010 | Castro | |
| 7,765,718 | B2 | 8/2010 | Wilkenfeld | |
| 7,793,947 | B2 | 9/2010 | Labonté | |
| 7,950,676 | B2 | 5/2011 | Goldsmith | |
| 8,033,393 | B2 | 10/2011 | Baker | |
| 8,596,650 | B2 | 12/2013 | Van Horne | |
| 8,684,368 | B2 | 4/2014 | Van Horne | |
| 8,800,168 | B1 | 8/2014 | Propet | |
| 9,004,502 | B2 | 4/2015 | Van Horne | |
| 9,226,843 | B2 | 1/2016 | Jones | |
| 2003/0150134 | A1 | 8/2003 | Hardt | |
| 2003/0196351 | A1 | 10/2003 | Hipps | |
| 2003/0204971 | A1 | 11/2003 | Fauver | |
| 2004/0016150 | A1 | 1/2004 | Labonté | |
| 2005/0108899 | A1 | 5/2005 | Kielt | |
| 2005/0116379 | A1 | 6/2005 | Goldsmith | |
| 2005/0134010 | A1 | 6/2005 | Blankenburg | |
| 2005/0193594 | A1 | 9/2005 | Murphy | |
| 2005/0229436 | A1 * | 10/2005 | Bock | A43B 5/1625 36/115 |
| 2005/0236784 | A1 * | 10/2005 | Zampieri | A43B 5/1641 280/11.27 |
| 2005/0280222 | A1 | 12/2005 | Sauter | |
| 2006/0053662 | A1 | 3/2006 | Yang | |
| 2007/0169887 | A1 * | 7/2007 | Kanagawa | D06N 3/0065 156/331.7 |
| 2007/0191749 | A1 | 8/2007 | Barberio | |
| 2009/0243238 | A1 | 10/2009 | Van Horne | |
| 2010/0156058 | A1 * | 6/2010 | Koyess | A43B 5/1616 280/11.12 |
| 2010/0192412 | A1 | 8/2010 | Stewart | |
| 2010/0212183 | A1 | 8/2010 | Seliger | |
| 2010/0263232 | A1 | 10/2010 | Smirman | |
| 2010/0275460 | A1 | 11/2010 | Ha | |
| 2010/0319217 | A1 * | 12/2010 | Echols | A43B 7/20 36/89 |
| 2011/0016752 | A1 | 1/2011 | Koyess | |
| 2011/0101665 | A1 | 5/2011 | Van Horne | |
| 2011/0289798 | A1 | 12/2011 | Hyun-Young | |
| 2012/0025478 | A1 | 2/2012 | Van Horne | |
| 2012/0083187 | A1 * | 4/2012 | Okamoto | C08G 18/6674 451/28 |
| 2012/0204452 | A1 | 8/2012 | Van Horne | |
| 2014/0013628 | A1 | 1/2014 | Van Horne | |
| 2014/0033575 | A1 | 2/2014 | Cruikshank | |
| 2014/0259792 | A1 | 9/2014 | Van Horne | |
| 2015/0250733 | A1 | 9/2015 | Cruikshank | |

OTHER PUBLICATIONS

Final Action dated Jun. 15, 2016 in connection with U.S. Appl. No. 14/810,321, 11 pages.
Non-final Office Action dated Oct. 3, 2016 in connection with U.S. Appl. No. 14/810,321, 8 pages.
Notice of Allowance dated Mar. 28, 2017 in connection with U.S. Appl. No. 14/810,321, 12 pages.
Non-final Office Action dated Aug. 29, 2017 in connection with U.S. Appl. No. 15/654,022, 6 pages.
Restriction Requirement dated Jul. 14, 2016 in connection with U.S. Appl. No. 14/512,252, 7 pages.
Office Action dated Oct. 7, 2016 in connection with U.S. Appl. No. 14/512,252, 14 pages.
Final Office Action dated May 4, 2017 in connection with U.S. Appl. No. 14/512,252, 32 pages.
Office action dated Oct. 31, 2017 in connection with U.S. Appl. No. 14/512,252, 17 pages.
Final Office Action dated Mar. 14, 2018 in connection with U.S. Appl. No. 14/512,252, 19 pages.
Office action dated Mar. 13, 2019 in connection with U.S. Appl. No. 14/515,252, 17 pages.

* cited by examiner

HOCKEY SKATE

CROSS-REFERENCE TO RELATED APPLICATION(S)

This application is a continuation of U.S. application Ser. No. 15/654,022, filed on Jul. 19, 2017, which is a continuation of U.S. patent application Ser. No. 14/810,321, filed on Jul. 27, 2015, and now U.S. Pat. No. 9,717,300, which is a continuation of U.S. application Ser. No. 14/028,258, filed Sep. 16, 2013 and now abandoned, which is a continuation of U.S. application Ser. No. 13/271,029, filed on Oct. 11, 2011 and now U.S. Pat. No. 8,596,650, which is a continuation of U.S. application Ser. No. 12/609,627, filed on Oct. 30, 2009 and now abandoned, all of which are incorporated herein by reference in their entireties.

FIELD OF THE INVENTION

The present disclosure generally relates to skates, and more particularly, to hockey skates.

BACKGROUND

Ice skating and inline skating are rather unique forms of human locomotion. There a variety of sports that utilize ice (or inline) skates such as, for example, speed skating, hockey, and figure skating. A skate boot is generally constructed of a material upper (e.g., leather and/or other synthetic material) adhered to a last board. The base is bonded to an outer sole made of plastic, rubber, or composite fibers, which effectively sandwiches the folded edge of the material upper between the last board and the outer sole. The rigid parts of the skate boot are comprised of the sole piece and a counter piece, which in combination provide the support structure of the footwear.

Recently, the sport of hockey has demanded improved skate boot technology to allow athletes to reach higher speeds and/or accelerate faster. As such, many recent hockey skate designs have borrowed technology from speed skating for improved performance. For example, speed skates are known to be comprised of a stiff shell structure 100 such as the structure identified in FIG. 1. As shown, the shell structure 100 is a unitary structure that includes a rear portion 102 and bottom portion 104. The rear portion 102 is formed to cover the rear half of a human foot including the heel. The bottom portion 104 is attached to a skate blade at points 106, 108. Because of the unitary design of shell structure 100, lateral energy is not wasted when a skater pushes from side to side and thus the skater can realize increased speeds. In addition, as shown, the shell structure 100 only partially covers a human ankle and tapers toward the rear of the skate to give the skater improved range of motion of the foot. For example, when using the shell structure 100, the skater can move their foot up, down, left, and right. This increased movement, due to the shell structure 100 partially covering the ankle, can also improve the skaters speed and/or acceleration. Although, the shell structure 100 can improve a skaters speed and/or acceleration, it is not practical for hockey because the design does not include many desired safety features required to protect the skater from impacts such as from, inter alia, pucks, sticks, and skate blades.

One common safety feature of a hockey skate is a tendon guard. Tendon guards are usually permanently attached to a rear of the skate that extends above a skater's ankle and extend upward therefrom in order to protect the skaters tendon from impacts. Although tendon guards serve a useful purpose, they can reduce movement of a skater's foot most notably upward and downward movement (e.g., dorsiflexion and planarflexion), which is undesirable.

Some skates have a tendon guard that is more flexible than the outer shell of the skate allowing the tendon guard to flex backwards and thus improving the movement of the skater's foot. These tendon guards are attached to the top of an ankle portion of the outer shell in a variety of ways such as, for example, via stitching, over molding, thermal bonding, high frequency welding, vibration welding, piping, zipper, adhesive, and staples. Accordingly, these tendon guards flex at the point of attachment, which can provide increased mobility of the skater's foot. However, movement of the skater's foot is still somewhat restricted because the ankle portion of the stiff outer shell covers the lower portion of the skater's Achilles tendon.

Accordingly, a need exists for an improved skate boot that can increase a skater's speed and acceleration while still providing adequate ankle support and protection for impact sports such as hockey.

BRIEF DESCRIPTION OF THE DRAWINGS

The invention will be more readily understood in view of the following description when accompanied by the below figures, wherein like reference numerals represent like elements.

DETAILED DESCRIPTION

In one example, a skate assembly includes a shell structure and a removable tendon guard. The shell structure includes a heel portion, a lateral ankle portion, and a medial ankle portion. The heel portion is formed to cover a human heel. The lateral ankle portion is formed to extend beyond the heel portion. The medial ankle portion is formed to extend beyond the heel portion. The lateral ankle portion and the medial ankle portion are spaced apart to form a notch extending downward toward the heel portion. The removable tendon guard is removably attached between the lateral ankle portion and medial ankle portion to cover the notch.

The skate assembly provides, among other advantages, increased mobility of a skater's foot, which can increase skating speed and/or acceleration of the skater. In addition, the skate assembly provides safety features suitable for impact sports such as hockey without compromising the mobility of the foot. Other advantages will be recognized by those of ordinary skill in the art.

Figure 1:
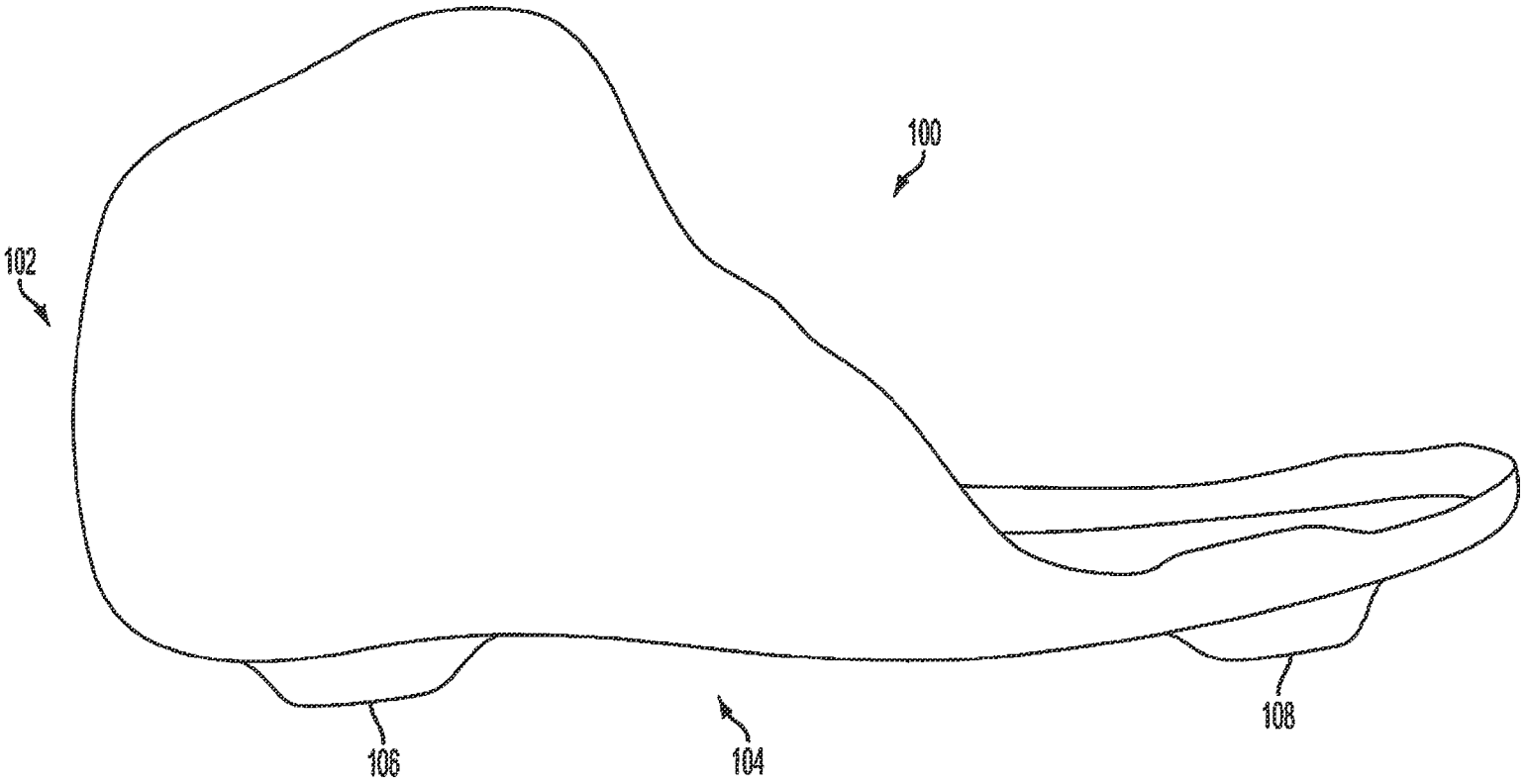
FIG. 1 PRIOR ART
FIG. 1 is an exemplary diagram of a speed skate shell according to the prior art.
Figure 2:
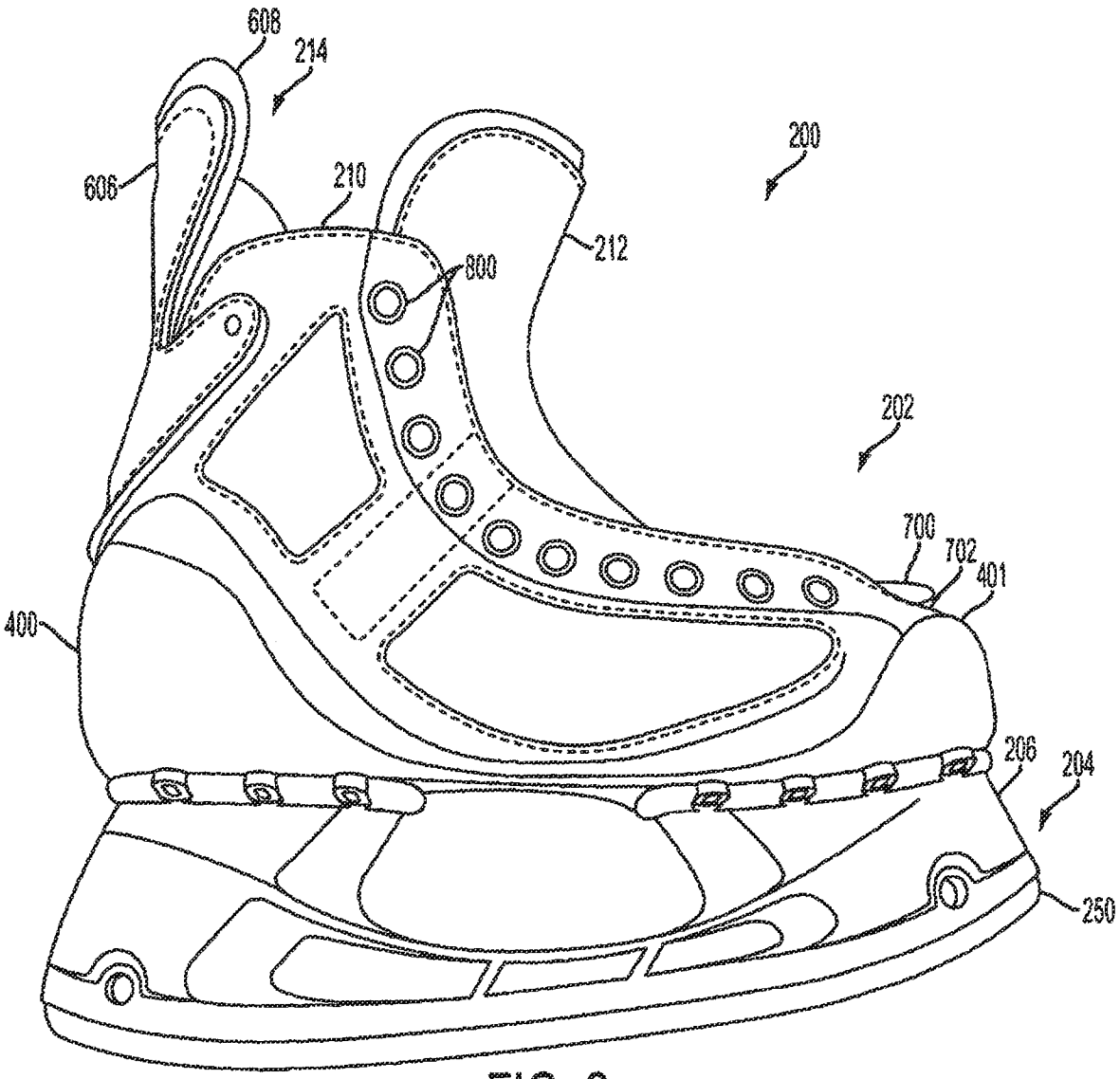
FIG. 2 is an exemplary diagram of a skate according to the present disclosure.
Figure 3:
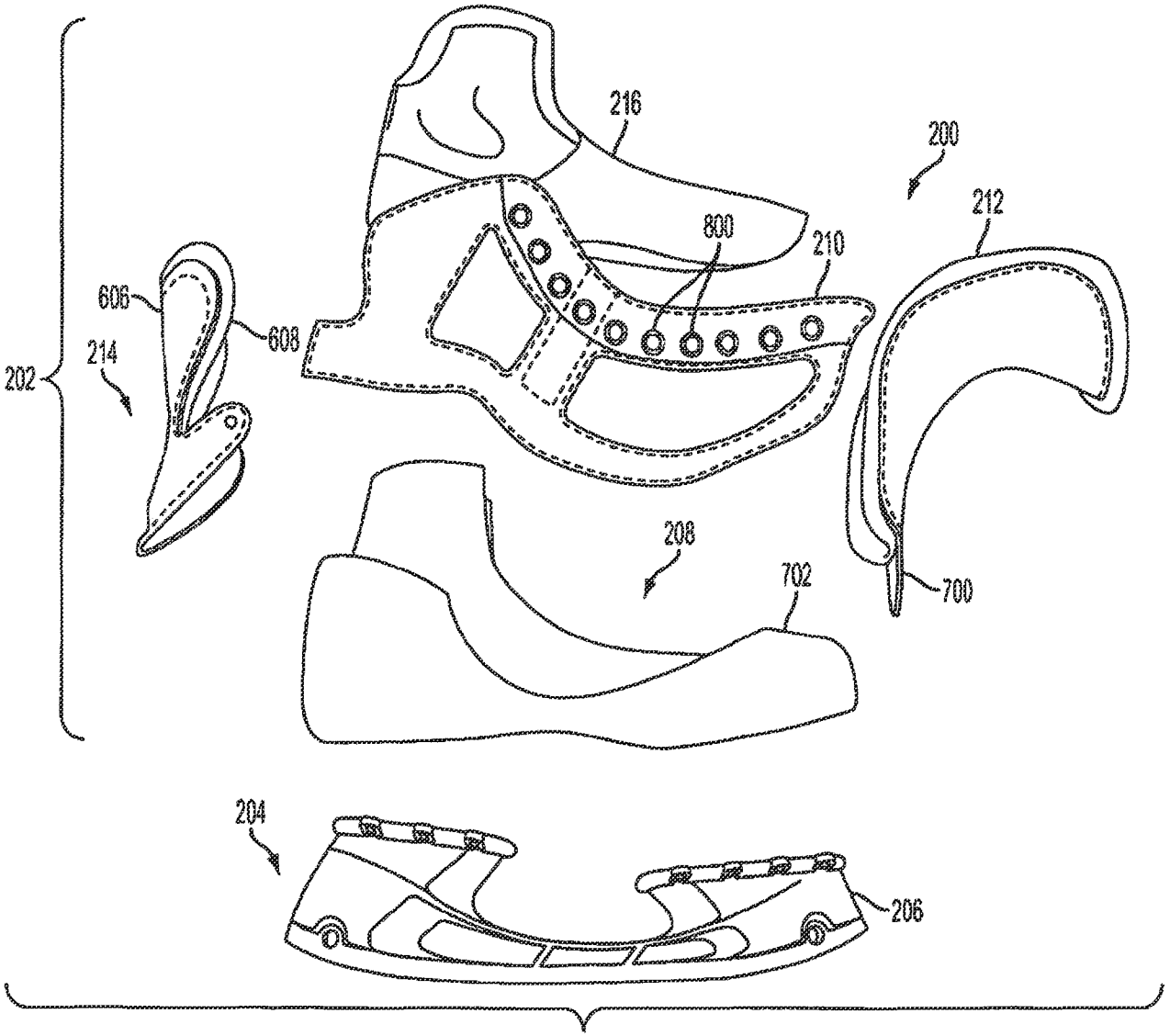
FIG. 3 is an exemplary exploded diagram of the skate.

Referring now to FIGS. 2 and 3, an exemplary diagram of a skate 200 such as an ice skate or inline roller skate is depicted. The skate 200 includes a skate boot 202 and a blade assembly 204. The blade assembly 204 includes a blade holder 206 and a skate blade 250. The blade holder 206 receives and secures the skate blade 250 in place.

The skate boot 202 includes a stiff unitary shell structure 208, a side panel 210 on the medial and lateral side of the skate boot 202, a removable tongue 212, a removable tendon guard 214, and an inner liner 216. The shell structure 208 can be made of any suitable stiff material such as for example, carbon fiber, aramid fiber, such as KEVLAR®, heat moldable thermoplastic, such as by Rhenoflex Corp of Germany, or other suitable thermoplastics that softens at a temperature under 80° C. For example, in one embodiment, the shell structure 208 can include a layer of carbon fiber, a layer of aramid fiber, and a layer of thermoplastic. In this example, the layer of aramid fiber can be sandwiched between the layer of carbon fiber and the layer of thermoplastic. In addition, the layer of carbon fiber can provide a hard exterior surface to the shell structure 208 and the layer of thermoplastic can provide a heat moldable interior of the shell structure 208.

The shell structure 208 can be manufactured in any suitable manner known in the art. For example, the shell structure 208 can be manufactured using a wet lay-up process. In this process, the thermoplastic is heated and shaped to a foot last. Next, pre-impregnated (pre-preg) carbon fiber and aramid fiber are layered over and onto the foot last. Thereafter, the layers on the foot last are vacuum bagged and heated until cured.

The thermoplastic is positioned over areas of the foot where maximal variation from individual to individual can occur such as the arch (or instep), ankle, metatarsus, and/or other suitable portions of the foot. In areas of the foot that have less shape variance, composite fibers can be used to provide a rigid and lightweight structure. The thermoplastic is designed to melt at a temperature at or around 60° C., although other suitable thermoplastics are contemplated. As such, the skate 200 can be placed in a conventional oven at or around 60° C. for approximately 20 minutes. Thereafter, the thermoplastic portions of the shell structure 208 can be easily formed to a particular foot.

Figure 4:
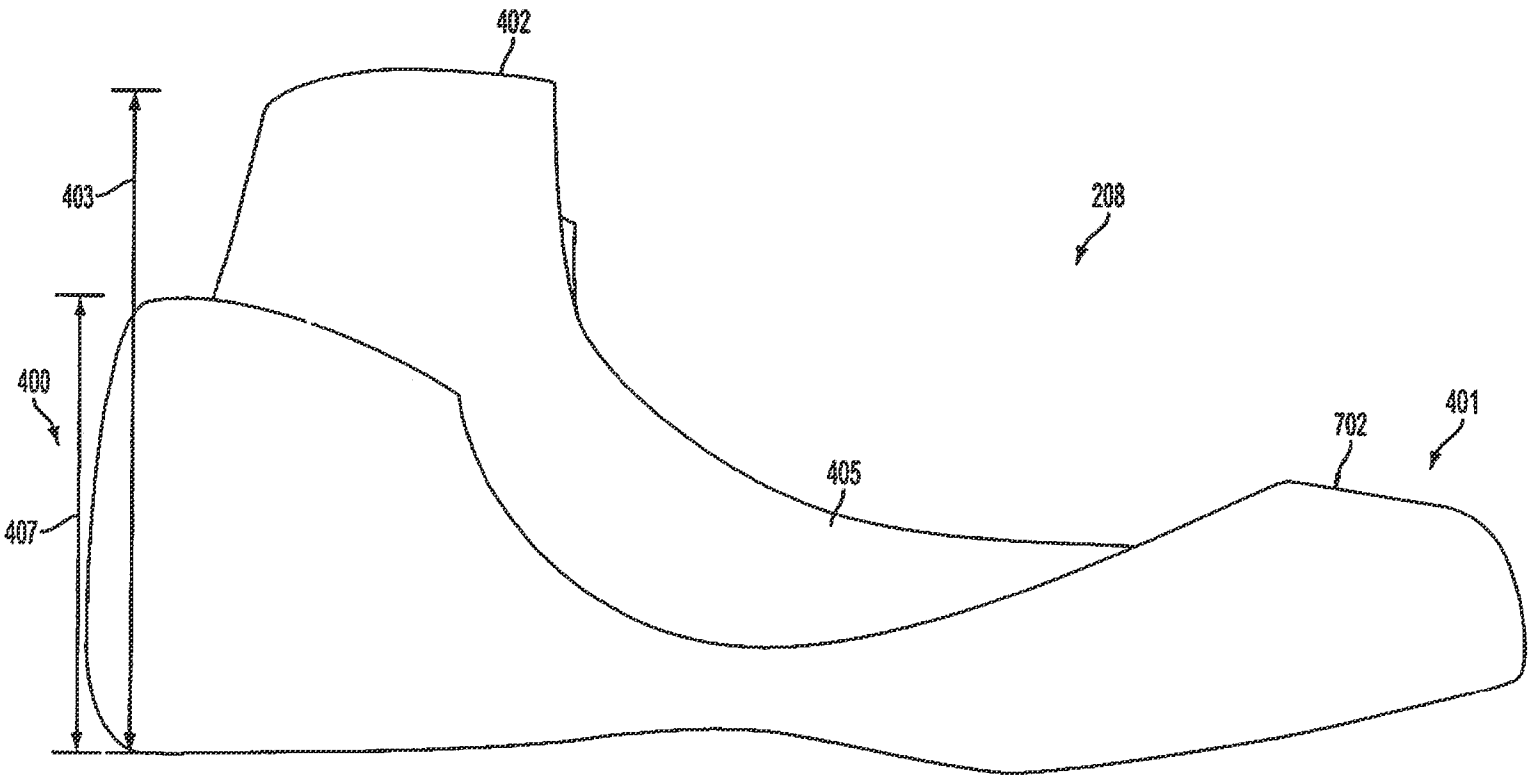
FIG. 4 is an exemplary side diagram of a shell structure of the skate.
Figure 5:
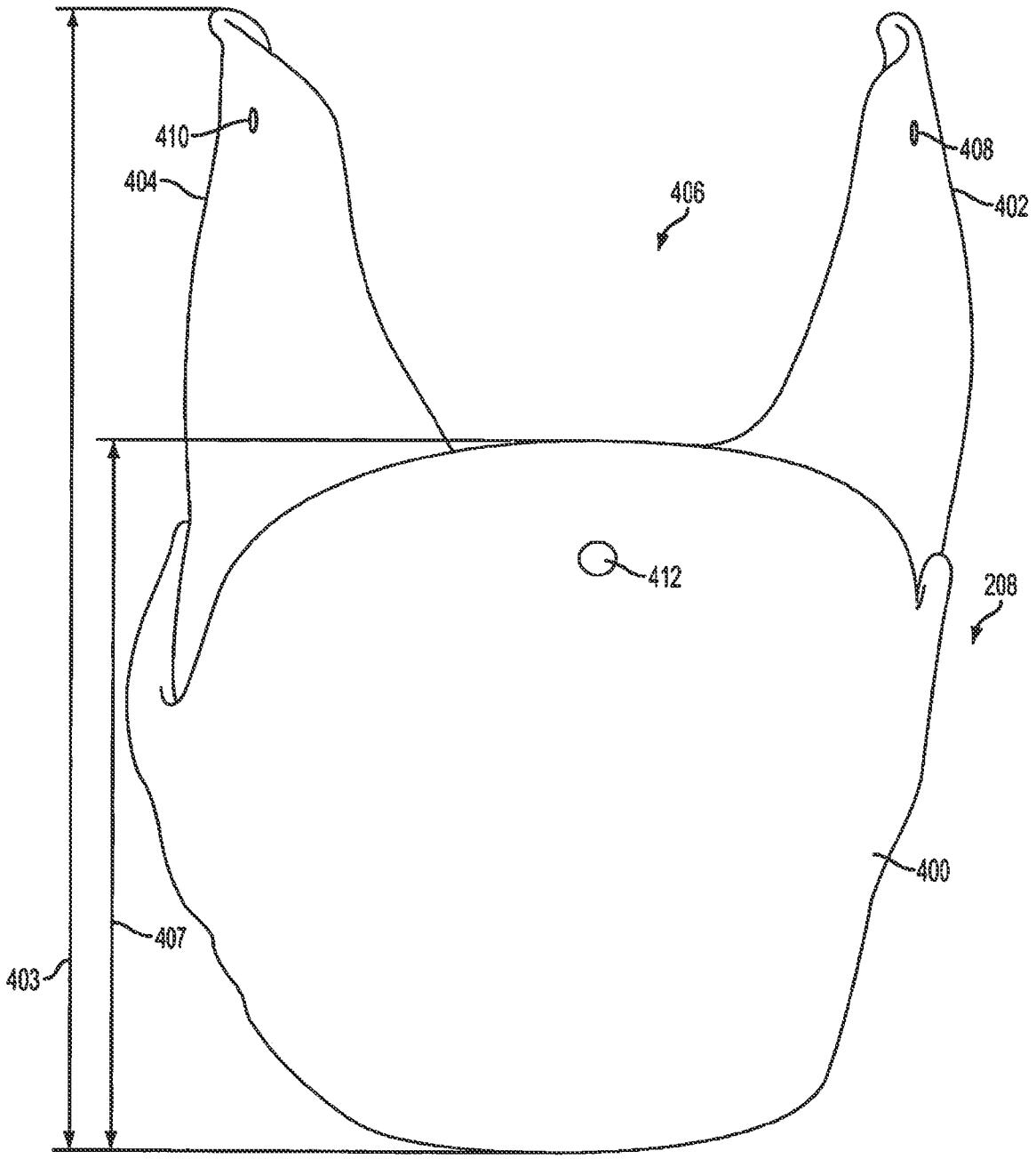
FIG. 5 is an exemplary rear diagram of the shell structure.

Referring now to FIGS. 4 and 5, the shell structure 208 includes a heel portion 400, a toe portion 401, a medial ankle portion 402, a lateral ankle portion 404, and an arch structure 405. The heel portion 400 is formed to cover a human heel. The toe portion 401 is formed to cover one or more human toes thereby providing protection thereto. The medial ankle portion 402 and the lateral ankle portion 404 are formed to extend beyond the heel portion 400 in order to cover and protect a human ankle. For example, in one embodiment, the heel portion 400 can have a heel height 407 that is approximately 65% of the ankle height 403 although other ratios are contemplated. The medial ankle portion 402 and the lateral ankle portion 404 are spaced apart to form a notch 406 extending toward the heel portion 400. In one example, the medial ankle portion 402 and the lateral ankle portion 404 are spaced apart by approximately 50 mm to 68 mm although other widths are contemplated. For example, in one embodiment, a size 6 has a notch spacing of approximately 60 mm, and a size 12 has a notch spacing of approximately 68 mm. The notch 406 begins just above a human heel in order to allow the Achilles tendon to move within the notch 406 thereby increasing a skater's range of motion when moving their foot up and down. As such, the notch 406 allows for increased (or in some circumstances uninhibited) movement of the ankle joint.

When the skate boot 200 is fully assembled, the removable tendon guard 214 is removably attached between the medial ankle portion 402 and the lateral ankle portion 404 to cover the notch. More specifically, the medial ankle portion 402 and the lateral ankle portion 404 are removably attached to the removable tendon guard 214. In addition, the removable tendon guard 214 can be removably attached to heel point 412 to further secure the removable tendon guard 214 to the shell structure 208. As such, the combination of the notch 406 and the removable tendon guard 214 provide increased (or in some cases uninhibited) flexion and/or extension while protecting the Achilles tendon.

As shown, the arch structure 405 is positioned between the heel portion 400 and the toe portion 401 and is proximate the medial ankle portion 402. The arch structure 405 is formed to fit the medial longitudinal arch of a human foot in order to provide arch support for the foot. The arch structure 405 can be made of any suitable material. For example, in one embodiment, the arch structure 405 can be made of a heat moldable thermoplastic that becomes moldable at a sufficient temperature (e.g., 60° C.) such that the foot will not be burned. As such, in this embodiment, the arch structure 405 can be custom molded to each individual foot for greater comfort and fit.

Likewise, in one embodiment, the medial ankle portion 402 and the lateral ankle portion 404 can also be made of a heat moldable thermoplastic that becomes moldable at a sufficient temperature (e.g., 60° C.) such that the foot will not be burned. Accordingly, the medial ankle portion 402 and the lateral ankle portion 404 can be custom molded to each individual's foot for greater comfort and fit.

Figure 6:
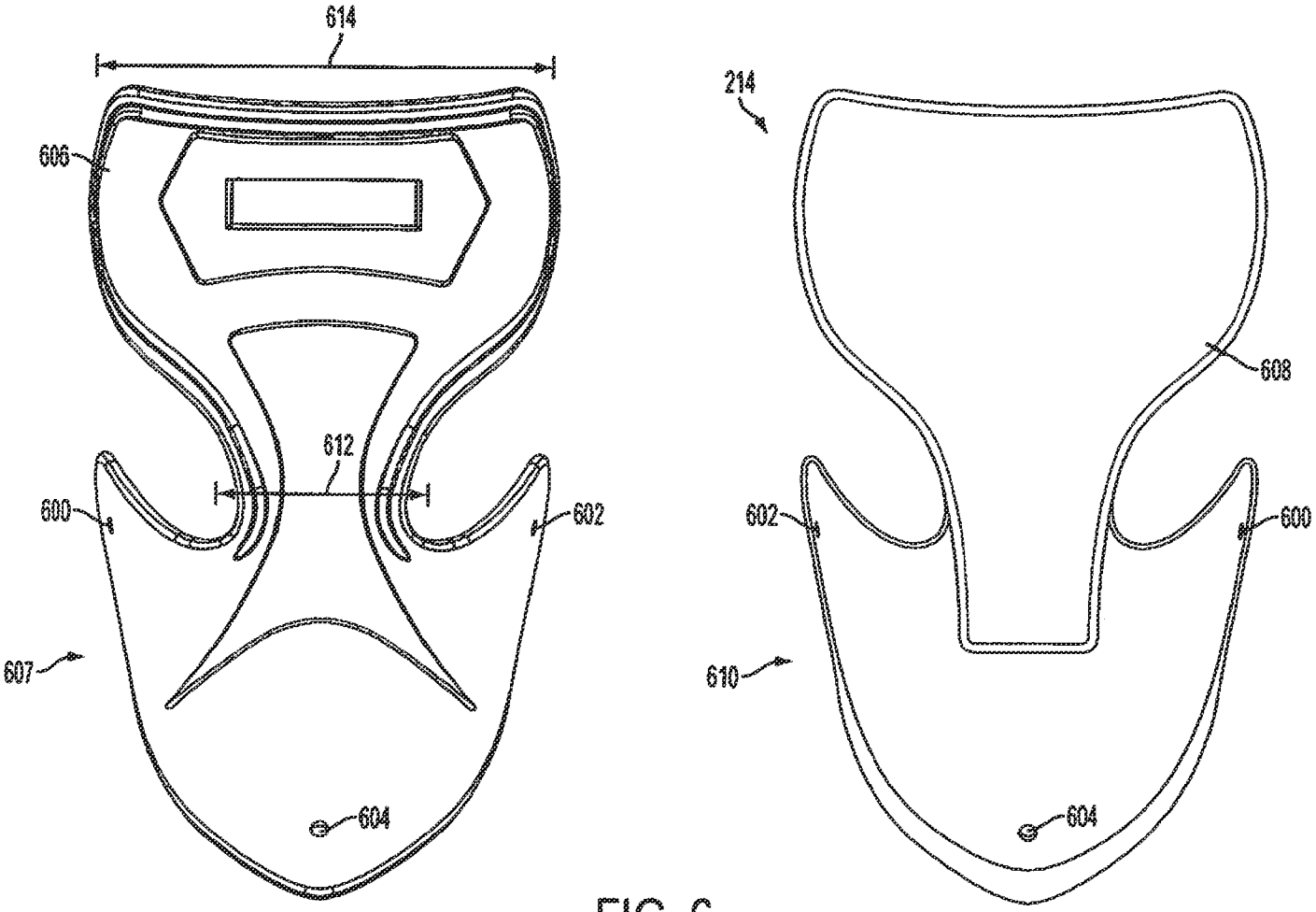
FIG. 6 is an exemplary diagram of a removable tendon guard according to the present disclosure.

Referring now to FIG. 6, an exemplary diagram of the removable tendon guard 214 is depicted. The removable tendon guard 214 can be removably attached to the skate boot 202 attached between the medial ankle portion 402 and lateral ankle portion 404 to cover the notch 406. More specifically, the removable tendon guard 214 includes a first attachment point 600 and a second attachment point 602. The first attachment point 600 can be removably attached to the lateral ankle portion 404 via lateral ankle point 410 and the second attachment point 602 can be removably attached to the medial ankle 402 via media ankle point 408. In addition, the removable tendon guard 214 can also include a third attachment point 604, which can be removably attached to heel point 412 to further secure the removable tendon guard 214 to the skate boot 202. The attachment points 600, 602, 604 can be removably attached to the skate boot 202 in any suitable manner. In one embodiment, the attachment points 600, 602, 604 can be removably attached to the skate boot 202 via bolts that pass through tendon guard holes and tighten to t-nuts that are anchored into the shell 208. Other suitable attachment methods are contemplated.

The removable tendon guard 214 can include an exterior portion 606 generally identified at 607 and an inner portion 608 generally identified at 610. The exterior portion 606 provides the main support structure and can be made of any suitable rigid material that provides pliability. For example, in one embodiment, the exterior portion 606 can be an injection molded plastic piece such as a pebax Nylon elastomer, ST 801 Dupont PS Nylon 66, or other suitable material. The inner portion 608 is a padded material to provide comfort when making contact with the Achilles tendon and/or other parts of the lower leg. In one embodiment, the inner portion 608 can be comprised of suitable comfort foam wrapped in a piece of CLARINO™ liner material although other materials are contemplated.

The removable tendon guard 214 has a narrow mid channel design. More specifically, the mid channel 612 is narrower and has a smaller dimension than the top width 614 of the removable tendon guard 214. The mid channel 612 can be any suitable width that is smaller than the top width 614. For example, in one embodiment, the mid channel 612 has a width that is ⅓ of the top width 614. In other embodiments, the mid channel 612 can be any suitable width that is less than 59% of the top width 614 although other dimensions are contemplated. The narrower mid channel 612 and corresponding notch 406 in the shell structure 208 allow a human ankle joint to extend more freely. For example, the back portion of the lower leg and Achilles tendon can pass through the notch 406 and engage the removable tendon guard 214, which allows continued movement through the increased flex allowed by the mid channel 612.

Figure 7:
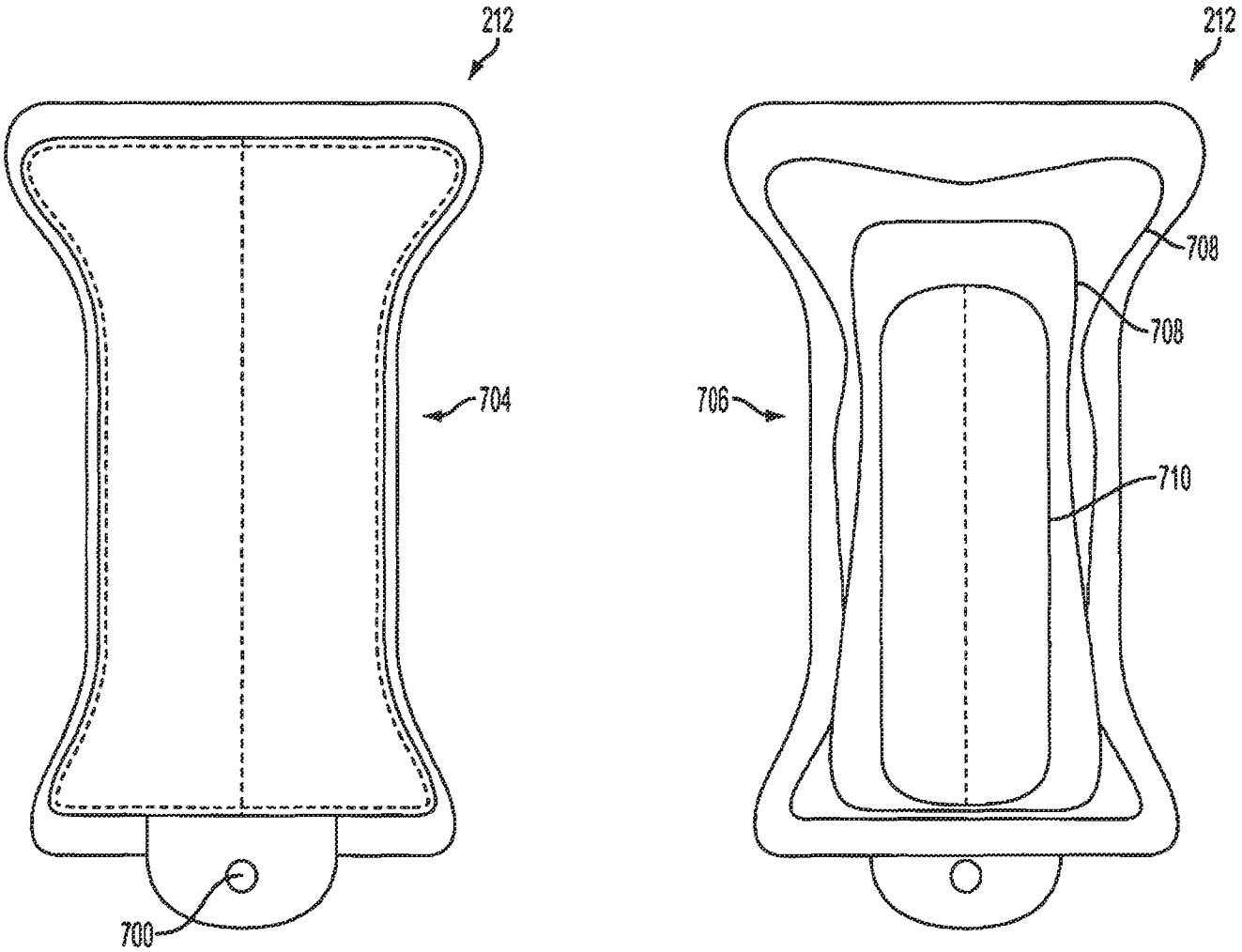
FIG. 7 is an exemplary diagram of a removable tongue according to the present disclosure.

Referring now to FIG. 7, an exemplary diagram of the removable tongue 212. The removable tongue 212 can be removably attached to the toe portion of 401 of the shell structure 208. For example, in one embodiment, the removable tongue 212 can include a tongue attachment point 700 that can be removably attached to a toe attachment point 702 of the shell structure 208 as depicted in FIGS. 2, 3, and 4. In one embodiment, the removable tongue 212 can be removably attached to the toe portion 401 via a bolt (or other structure) that fastens to a t-nut that is housed in the toe portion 401 proximate the toe attachment point 702. The removable tongue 212 simplifies manufacturing since the skate boot 202 and the removable tongue 212 can be manufactured separately and attached during final assembly. In addition, the removable tongue 212 can be easily replaced should it become damaged or for any other reason.

Referring back to FIG. 7, the removable tongue 212 can include an exterior portion 704 and an inner portion 706. In one embodiment, the removable tongue 212 is comprised of one or more layers of foam layers 708. For example, in one embodiment, two foam layers are used that have different densities. In this example, the softer layer can be positioned proximal a skater's foot and the stiffer layer can be positioned on top of the soft layer (e.g., distal the skater's foot). This configuration can be advantageous in that it provides comfort to the skater's foot and can reduce (or in some cases prevent) lace bite (e.g., the effect of laces causing localized pressure on the top the foot resulting in soreness and bruising).

The removable tongue 212 is also comprised of one or more pieces of thermoplastic 710 that softens at or around 60° C. for safe anatomical shaping. In one embodiment, the removable tongue 212 is also comprised of two pieces of thermoplastic 710. The thermoplastic 710 can be bonded to the tongue in any suitable location such as the outermost foam layer 708, for example. The thermoplastic 710 provides rigidity and support to the tongue. In addition, when heated, the removable tongue 212 can be custom shaped to a particular skater's foot. The foam layer 708 and the thermoplastic 710 can be covered with a thin piece of black felt material to provide added comfort if desired.

Figure 8:
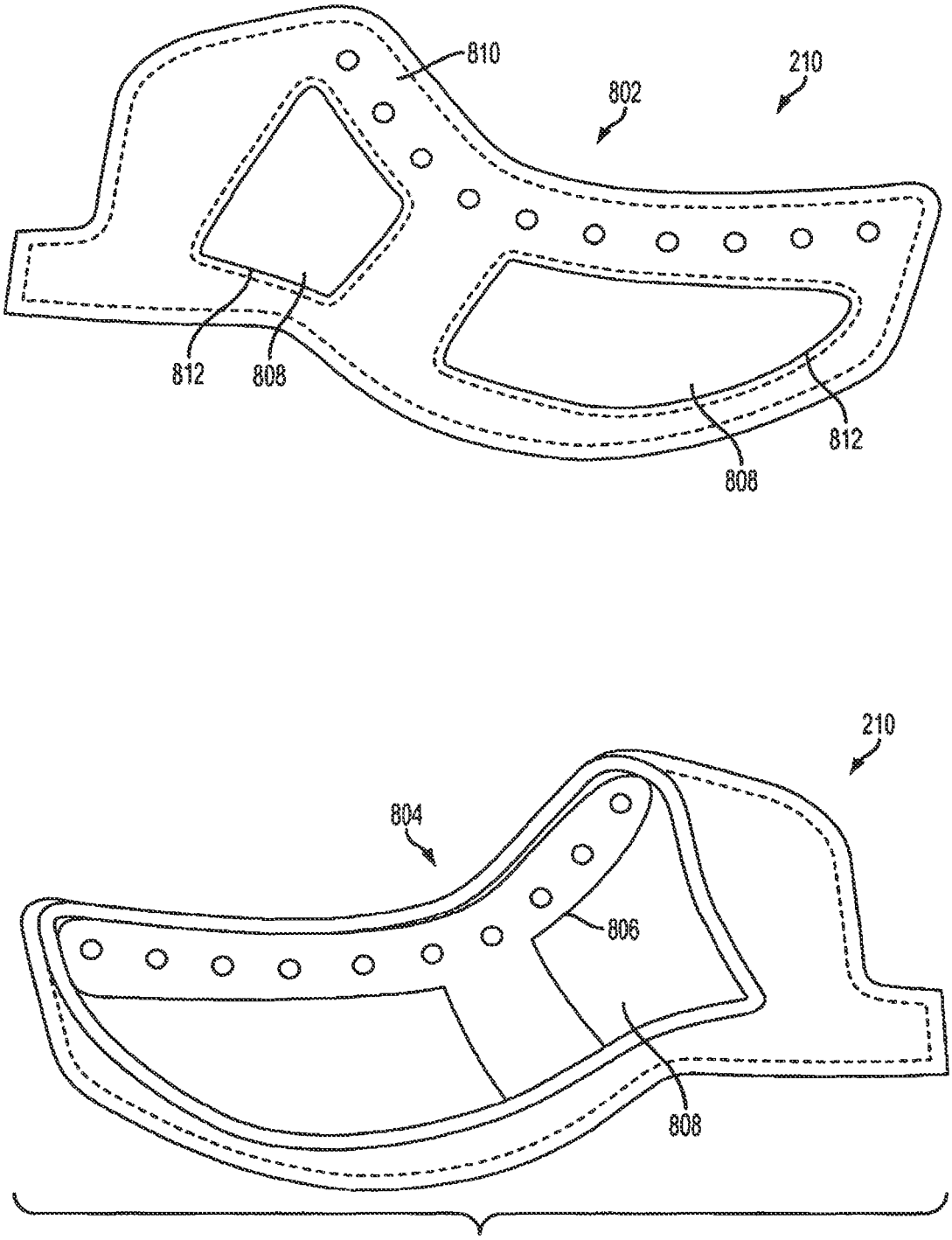
FIG. 8 is an exemplary diagram of a side panel of the skate.

Referring now to FIG. 8, an exemplary diagram of the side panel 210 is depicted. The side panel 210 can include an exterior portion 802 and an inner portion 804. The side panel 210 is bonded to the shell structure 208 and stitched to the inner liner 216 of the skate boot 202. The side panel 210 can be bonded to the shell structure 208 using any suitable solvent based adhesive such as contact cement or other suitable adhesive.

The side panel 210 supports and houses eyelets 800. As such, the side panel 210 is reinforced with a reinforcement material 806 in order to prevent tearing when the skate boot 202 is laced up. Any suitable material can be used to reinforce the side panel 210 such as an aramid fiber material (e.g., KEVLAR®), for example. In addition, the side panel 210 can include a thermoplastic 808 that softens at or around 60° C. for safe anatomical shaping. The thermoplastic 808 further supports and gives rigidity to the eyelets 800. Furthermore, the side panel 210 can be heat shaped to the skate 202 boot during manufacturing. Moreover, when the skate boot 202 is heat molded to a particular skater's foot, the side panel 210 custom forms to their foot shape. In some embodiments, the side panel 210 can include a synthetic leather 810 to provide an aesthetically pleasing skate boot design. In addition, one or more portions 812 can be removed from the synthetic leather 810 revealing the thermoplastic 808, which can be used to display company graphics and/or logos if desired.

Figure 9:
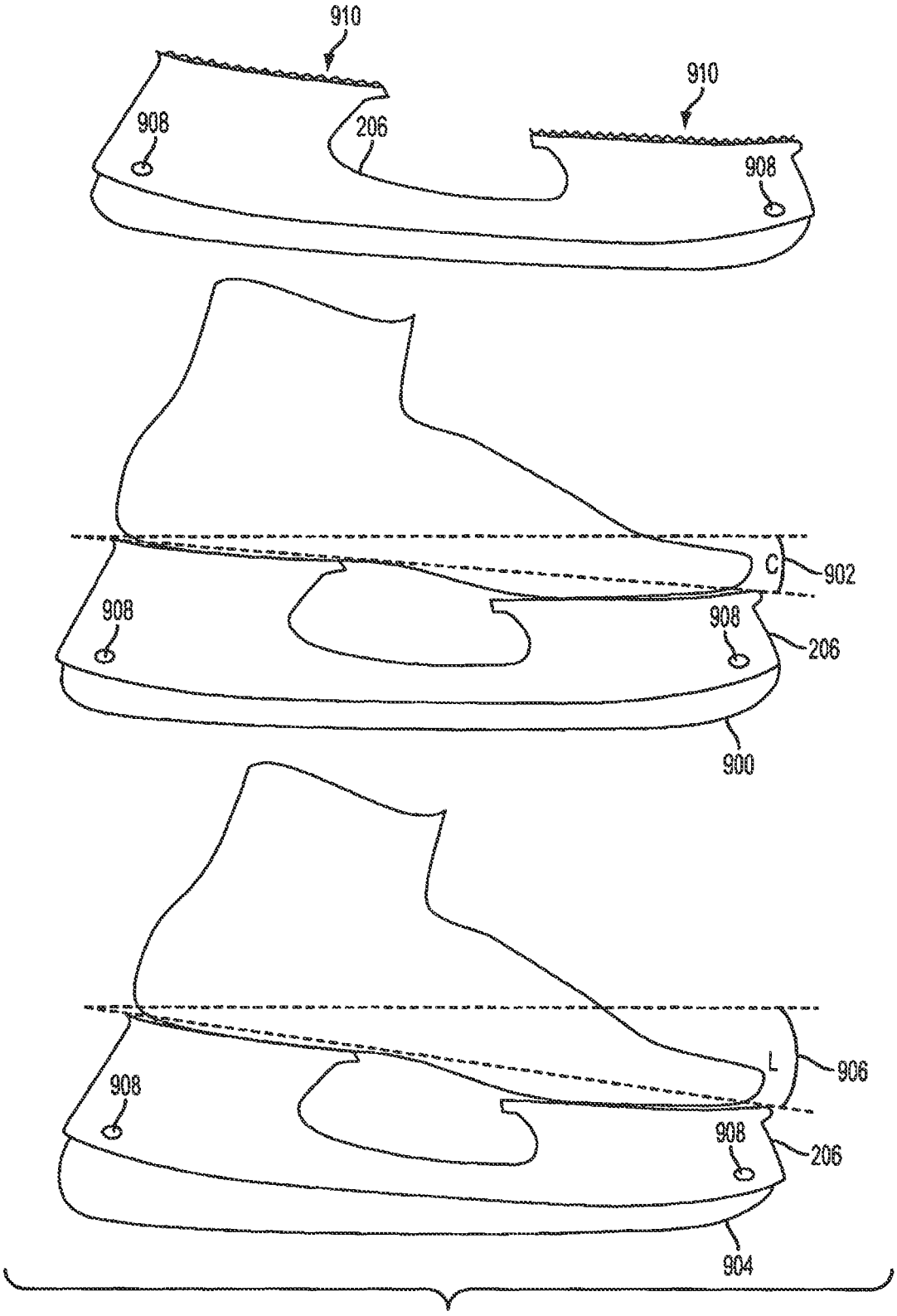
FIG. 9 is an exemplary diagram of a blade holder according to the present disclosure.

Referring now to FIG. 9, an exemplary diagram of the blade holder 206 having various blade profiles attached is depicted. The blade holder 206 can be attached to various blade profiles that have different radial profiles in order to achieve variations of sagital plane foot to ice angles. For example, the blade holder 206 can hold a substantially uniform blade 900 that provides a first foot to ice angle 902 if desired. In addition, the blade holder 206 can hold a raised heel blade 904 that provides a second foot to ice angle 906 if desired. Furthermore, the blade holder 206 can hold a raised toe blade (not shown) that provides a third foot to ice angle (not shown) if desired. Accordingly, the skate 200 can be customized to each particular skaters requirements in order to provide greater comfort and/or skating performance.

The skate blades are attached to the blade holder 206 via attachment points 908 at each end of the blade holder 206. By having the attachment points 908 at each end of the blade holder 206, the blade can flex when the skater applies force to the skate 200, which can result in improved control while skating. The further the attachment points 908 are from each other, the more the blade flexes. The attachment points 908 can be any suitable distance apart to achieve the desired flex. For example, a 30.9 cm blade can have the attachment points 908 separated by approximately 25.3 cm if desired. In another example, one of the attachment points 908 can be approximately 3.2 cm from the front of the blade holder 206 and the other attachment point 908 can be 2.5 cm from the back of the blade holder 206 although other distances are contemplated.

The skate blades can be attached to the blade holder 206 in any suitable manner. For example, in one embodiment, a suitable bolt and nut can be used to attach the skate blade to the blade holder 206. As such, in this embodiment, the skate blade and the blade holder 206 can be removably attached so that the skate blade can be easily replaced. Other attachment methodologies are contemplated.

In one embodiment, the blade holder 206 includes a textured surface 910 that has a rough or slightly spiky surface. For example, in one embodiment, the textured surface 910 can be comparable to that of sand paper, such as 60 grit or other suitable grit sandpaper. The textured surface 910 engages with the bottom of the skate boot 202 (e.g., the shell structure 208) when attached to the skate boot 202. As such, the textured surface 910 causes the blade holder 206 to bite into the skate boot 202 and thus inhibits medial and/or lateral movement of the blade holder 206 with respect to the skate boot 202.

Figure 10:
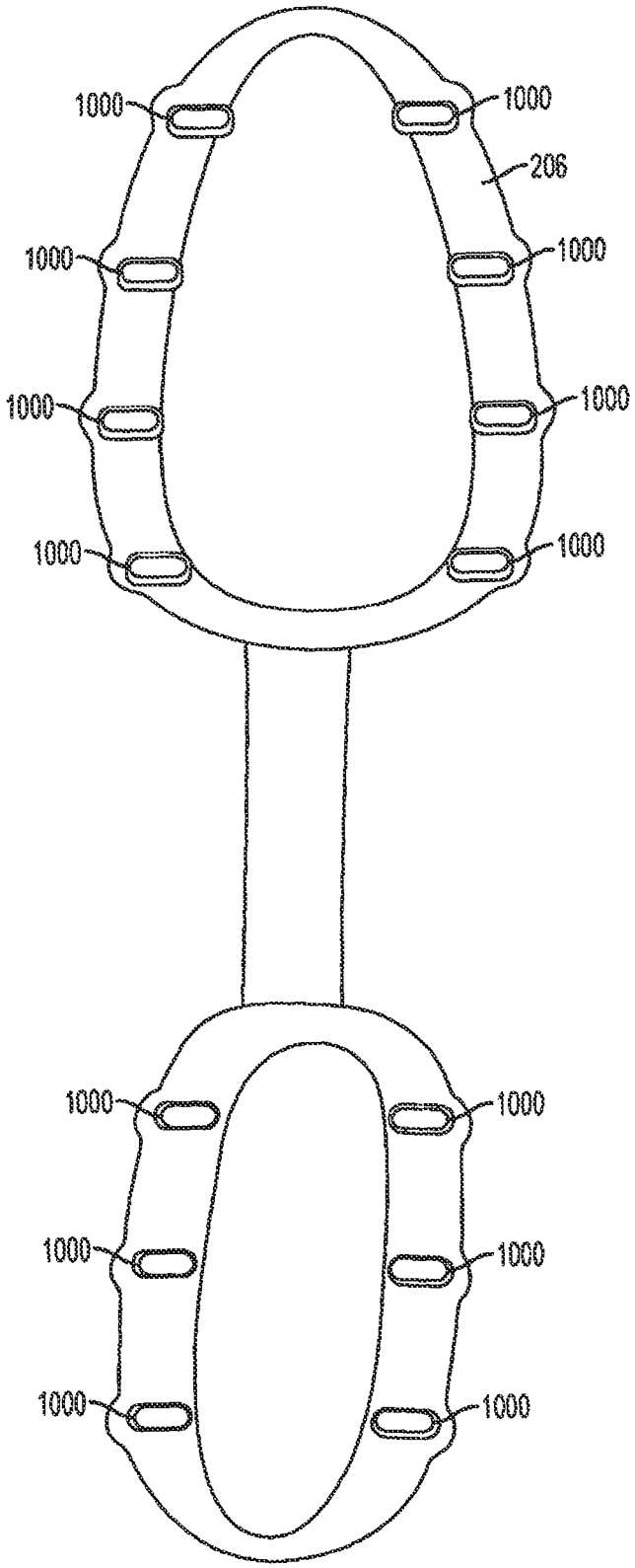
FIG. 10 is another exemplary diagram of the blade holder.
Figure 11:
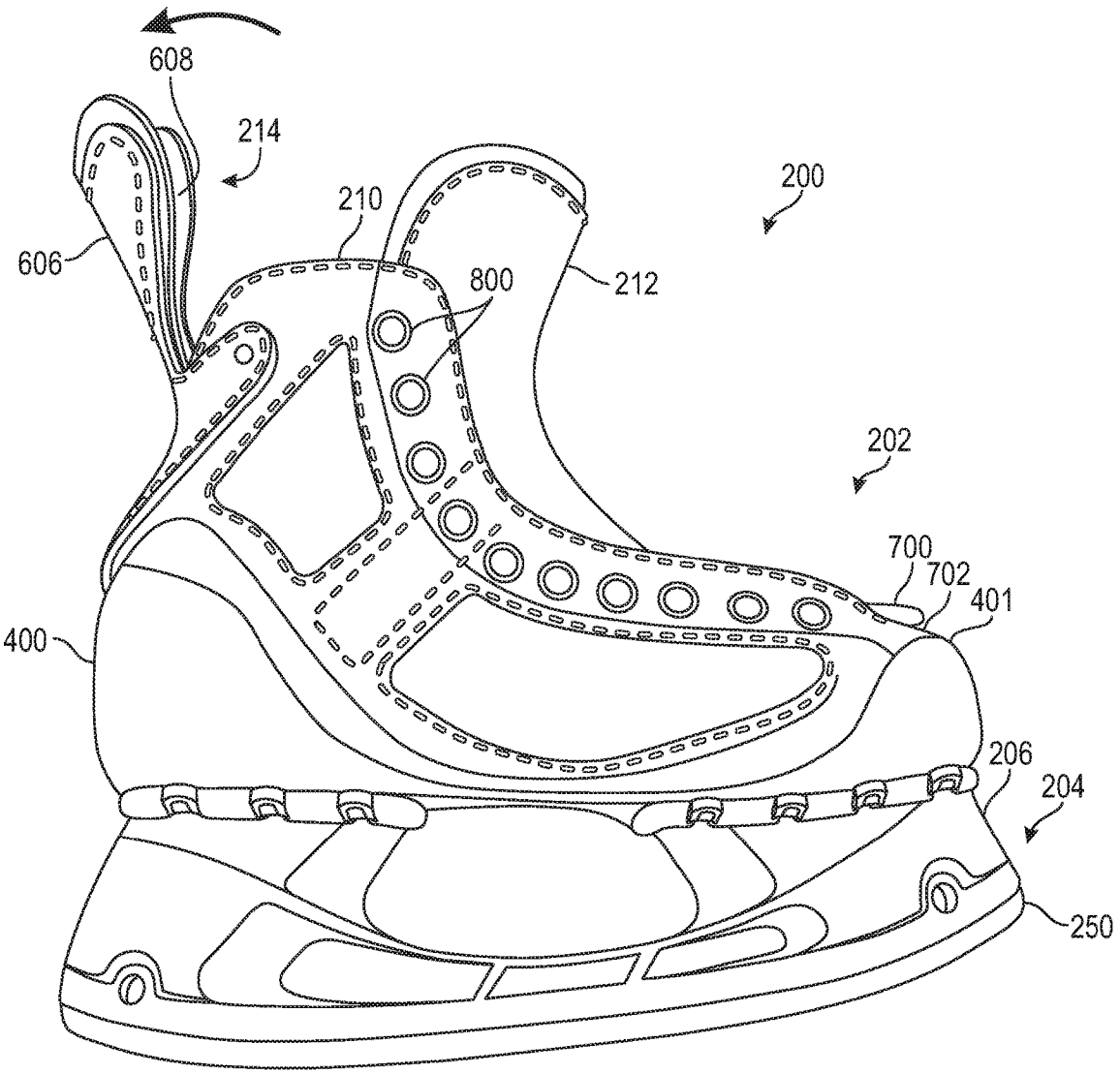
FIG. 11 is an exemplary diagram of a skate with a tendon guard flexed in the rearward direction away from the toe end.
Figure 12:
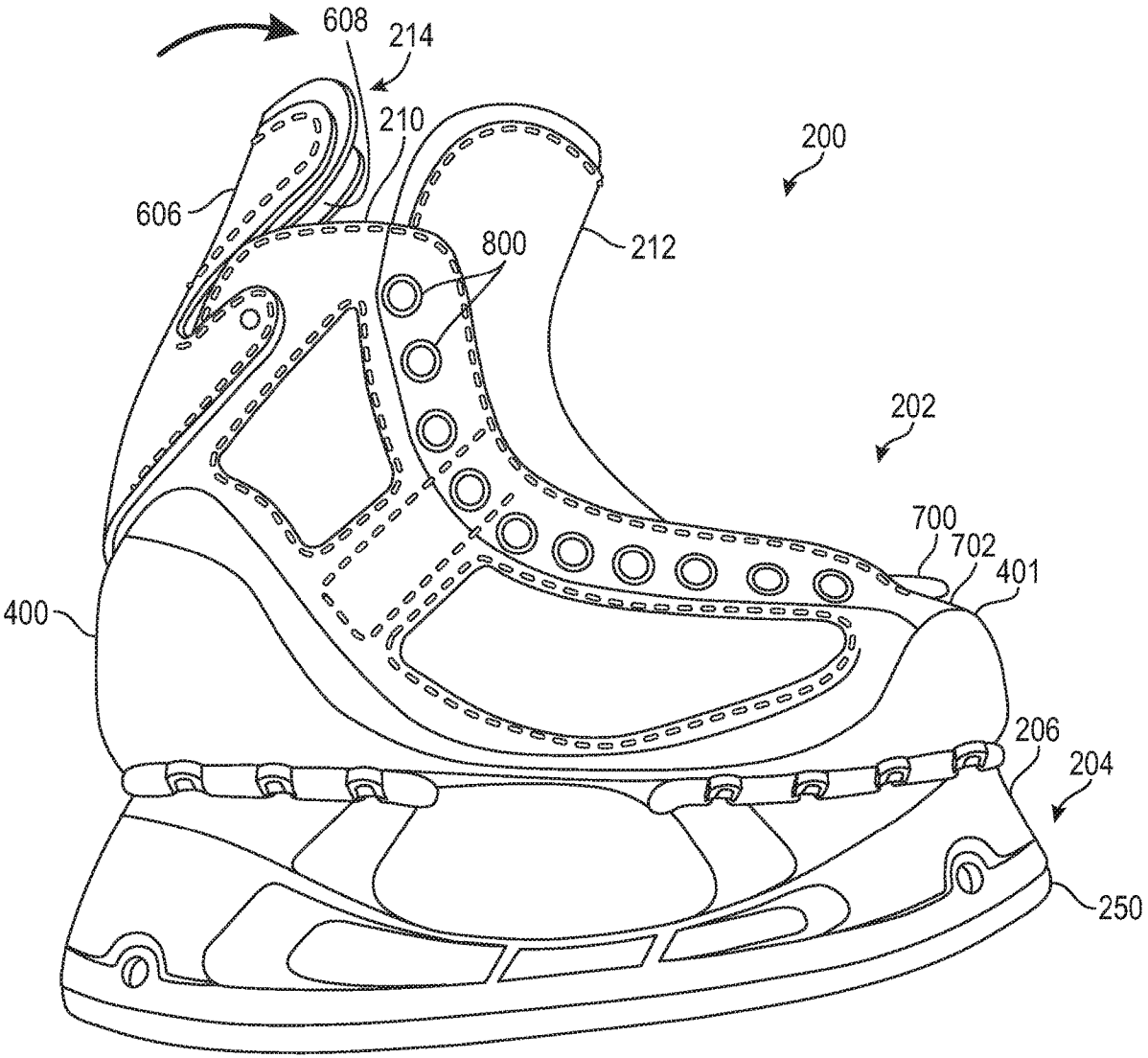
FIG. 12 is an exemplary diagram of the skate shown in FIG. 11 with the tendon guard flexed in the forward direction toward the toe end of the skate.

Referring now to FIG. 10, a top view of the blade holder 206 is depicted. The blade holder 206 can be made from any suitable polymer material known in the art. For example, in one embodiment, the blade holder 206 can be made of ST 801 Dupont PS Nylon 66. In another embodiment, the blade holder 206 can be made from a polymer having more flexibility such as pebax Nylon elastomer, for example. The advantage of using different polymers having different flexibility provides a skater greater customization to improve performance and/or comfort. For example, a skater that wishes to accelerate faster may choose to use a blade holder made of a more flexible material such as pebax Nylon elastomer, for example. However, a skater that wishes to have a higher top end speed may choose to use a blade holder made of a more rigid less flexible material such as ST 801 Dupont PS Nylon 66, for example.

The blade holder 206 includes multiple attachment points 1000 that can be attached to the skate boot 202 (e.g., the shell structure 208) via any suitable means such as a nut and bolt, a rivet, and/or other suitable attachment means. In this example, there are eight attachment points 1000 (i.e., four on each side) on the front portion of the blade holder 206 and six attachment points 1000 (i.e., three on each side) on the rear (or heel) of the blade holder 206 although any suitable number of attachment points 1000 may be used if desired.

The attachment points 1000 are apertures having an elongated shape such as a slot, elliptical, or other suitable elongated shape. Due to the elongated shape of the apertures, a skater can adjust the position of the blade holder 206 with respect to the skate boot 202 as desired. For example, the blade holder 206 can be adjusted laterally in order to center the blade for each particular skater's center of gravity. As such, the blade holder 206 is adjustable with respect to the skate boot 202 and thus can be adjusted to enhance comfort and/or performance for a particular skater.

As noted above, the blade holder 206 includes the textured surface 910 to ensure that there is no slippage of the blade holder 206 with respect to the skate boot 202 during skating. In one embodiment, the bottom side of the skate boot 202 can be coated with polyurethane or bonded with a thin piece of leather to further aid the textured surface 910 in preventing movement between the skate boot 202 and the blade holder 206.

Among other advantages, the skate 200 provides increased mobility of a skater's foot due to the notch 406 and removable tendon guard 214, which can increase skating speed and/or acceleration of the skater. In addition, the skate 200 provides safety features suitable for impact sports such as hockey without compromising the mobility of the foot. Furthermore, the skate 200 has multiple components that are removably attached and/or adjustable so that a particular skater can customize the skate 200 to meet their individual needs. Other advantages will be recognized by those of ordinary skill in the art.

While this disclosure includes particular examples, it is to be understood that the disclosure is not so limited. Numerous modifications, changes, variations, substitutions, and equivalents will occur to those skilled in the art without departing from the spirit and scope of the present disclosure upon a study of the drawings, the specification, and the following claims.

What is claimed is:

1. A skate boot for a skate, the skate comprising a blade holder and a blade held by the blade holder, the skate boot being configured to receive a foot of a user, the skate boot comprising a one-piece shell that comprises a heel portion configured to face a heel of the user's foot, an ankle portion configured to face an ankle of the user, a medial side portion configured to face a medial side of the user's foot, a lateral side portion configured to face a lateral side of the user's foot, and a sole portion configured to face a plantar surface of the user's foot and includes fiber-reinforced composite material comprising rigid fibers, wherein: the sole portion of the one-piece shell is configured to contact and be directly secured to the blade holder; the ankle portion comprises a medial ankle portion and a lateral ankle portion that are spaced apart from one another and that define a U-shaped notch extending towards the heel portion of the one-piece shell; the skate boot comprises a heel portion; and the heel portion of the one-piece shell defines an outermost surface of the skate boot at the heel portion of the skate boot.

2. The skate boot of claim 1, wherein the sole portion of the one-piece shell includes at least part of the fiber-reinforced composite material.

3. The skate boot of claim 2, wherein the sole portion of the one-piece shell includes a coating on the fiber-reinforced composite material to contact the blade holder.

4. The skate boot of claim 3, wherein the coating is a polyurethane coating.

5. The skate boot of claim 1, wherein the rigid fibers include carbon fibers.

6. The skate boot of claim 1, wherein the rigid fibers include at least one of (i) carbon fibers and (ii) aramid fibers.

7. The skate boot of claim 1, wherein the one-piece shell includes heat-moldable thermoplastic material to be thermoformable to the user's foot.

8. The skate boot of claim 7, wherein the one-piece shell comprises an arch region configured to engage a medial arch of the user's foot and including at least part of the heat-moldable thermoplastic material to be thermoformable to the medial arch of the user's foot.

9. The skate of claim 7, wherein the heat-moldable thermoplastic material is configured to become moldable at around 60° C.

10. The skate boot of claim 1, wherein the one-piece shell comprises a toe portion configured to receive toes of the user's foot.

11. A skate comprising:

the skate boot of claim 1;

a blade holder contacting and directly secured to the sole portion of the one-piece shell; and a blade held by the blade holder.

12. The skate of claim 11, wherein the blade holder comprises a textured surface contacting the sole portion of the one-piece shell.

13. The skate of claim 1, wherein the skate boot comprises a toe portion, and the one-piece shell defines an outermost surface of the skate boot between the heel portion of the skate boot and the toe portion of the skate boot.

14. A skate boot for a skate, the skate comprising a blade holder and a blade held by the blade holder, the skate boot being configured to receive a foot of a user, the skate boot comprising a one-piece shell that comprises a heel portion configured to face a heel of the user's foot, an ankle portion configured to face an ankle of the user, a medial side portion configured to face a medial side of the user's foot, a lateral side portion configured to face a lateral side of the user's foot, and a sole portion configured to face a plantar surface of the user's foot and includes fiber-reinforced composite material comprising rigid fibers, wherein: the sole portion of the one-piece shell is configured to contact and be directly secured to the blade holder; the ankle portion comprises a medial ankle portion and a lateral ankle portion that are spaced apart from one another and that define a notch, the notch extending towards the heel portion of the one-piece shell and forming a U-shaped notch; the one-piece shell includes heat-moldable thermoplastic material to be thermoformable to the user's foot; the one-piece shell comprises an arch region configured to engage a medial arch of the user's foot and including at least part of the heat-moldable thermoplastic material to be thermoformable to the medial arch of the user's foot; the skate boot comprises a heel portion; and the heel portion of the one-piece shell defines an outermost surface of the skate boot at the heel portion of the skate boot.

15. The skate boot of claim 14, wherein the sole portion of the one-piece shell includes at least part of the fiber-reinforced composite material.

16. The skate boot of claim 14, wherein the rigid fibers include carbon fibers.

17. The skate boot of claim 14, wherein the rigid fibers include at least one of (i) carbon fibers and (ii) aramid fibers.

18. The skate boot of claim 14, wherein the sole portion of the one-piece shell includes a coating on the fiber-reinforced composite material to contact the blade holder.

19. The skate boot of claim 18, wherein the coating is a polyurethane coating.

20. The skate boot of claim 14, wherein the one-piece shell comprises a toe portion configured to receive toes of the user's foot.

21. A skate comprising:

the skate boot of claim 14;

a blade holder contacting and directly secured to the sole portion of the one-piece shell; and a blade held by the blade holder.

22. The skate of claim 21, wherein the blade holder comprises a textured surface contacting the sole portion of the one-piece shell.

23. The skate of claim 14, wherein the heat-moldable thermoplastic material is configured to become moldable at around 60° C.

24. A skate boot for a skate, the skate comprising a blade holder and a blade held by the blade holder, the skate boot being configured to receive a foot of a user, the skate boot comprising a one-piece shell that comprises a heel portion configured to face a heel of the user's foot, an ankle portion configured to face an ankle of the user, a medial side portion configured to face a medial side of the user's foot, a lateral side portion configured to face a lateral side of the user's foot, and a sole portion configured to face a plantar surface of the user's foot and includes fiber-reinforced composite material comprising rigid fibers, wherein: the sole portion of the one-piece shell is configured to contact and be directly secured to the blade holder; the ankle portion comprises a medial ankle portion and a lateral ankle portion that are spaced apart from one another and that define a notch, the notch extending towards the heel portion of the one-piece shell and forming a U-shaped notch; the one-piece shell comprises a coating on the fiber-reinforced composite material; the skate boot comprises a heel portion; and the heel portion of the one-piece shell defines an outermost surface of the skate boot at the heel portion of the skate boot.

25. The skate boot of claim 24, wherein the sole portion of the one-piece shell includes at least part of the fiber-reinforced composite material.

26. The skate boot of claim 24, wherein the rigid fibers include carbon fibers.

27. The skate boot of claim 24, wherein the rigid fibers include at least one of (i) carbon fibers and (ii) aramid fibers.

28. The skate boot of claim 24, wherein the one-piece shell includes heat-moldable thermoplastic material to be thermoformable to the user's foot.

29. The skate boot of claim 28, wherein the one-piece shell comprises an arch region configured to engage a medial arch of the user's foot and including at least part of the heat-moldable thermoplastic material to be thermoformable to the medial arch of the user's foot.

30. The skate of claim 28, wherein the heat-moldable thermoplastic material is configured to become moldable at around 60° C.

31. The skate boot of claim 24, wherein the sole portion of the one-piece shell includes at least part of the coating disposed to contact the blade holder.

32. The skate boot of claim 24, wherein the coating is a polyurethane coating.

33. The skate boot of claim 24, wherein the one-piece shell comprises a toe portion configured to receive toes of the user's foot.

34. A skate comprising:

the skate boot of claim 24;

a blade holder contacting and directly secured to the sole portion of the one-piece shell; and a blade held by the blade holder.

35. The skate of claim 34, wherein the blade holder comprises a textured surface contacting the sole portion of the one-piece shell.

36. A skate boot for a skate, the skate comprising a blade holder and a blade held by the blade holder, the skate boot being configured to receive a foot of a user, the skate boot comprising a one-piece shell that comprises a heel portion configured to face a heel of the user's foot, an ankle portion configured to face an ankle of the user, a medial side portion configured to face a medial side of the user's foot, a lateral side portion configured to face a lateral side of the user's foot, and a sole portion configured to face a plantar surface of the user's foot and includes fiber-reinforced composite material comprising rigid fibers, wherein: the sole portion of the one-piece shell is configured to contact and be directly secured to the blade holder; the ankle portion comprises a medial ankle portion and a lateral ankle portion that are spaced apart from one another and that define a U-shaped notch extending towards the heel portion of the one-piece shell; the skate boot comprises a heel portion and a toe portion; and the one-piece shell defines an outermost surface of the skate boot between the heel portion of the skate boot and the toe portion of the skate boot.

* * * * *